United States Patent [19]

Quellais et al.

[11] Patent Number: 4,967,904

[45] Date of Patent: Nov. 6, 1990

[54] GOLF BAG

[75] Inventors: Jacques Quellais, Saint Jorioz; Frederic Cretinon, Sevrier, both of France

[73] Assignee: Salomon, S.A., Annecy Cedex, France

[21] Appl. No.: 428,401

[22] Filed: Oct. 25, 1989

Related U.S. Application Data

[63] Continuation of Ser. No. 186,143, Apr. 26, 1988, abandoned.

[30] Foreign Application Priority Data

Apr. 30, 1987 [FR] France ..... 87 06181
Jun. 19, 1987 [FR] France ..... 87 08624

[51] Int. Cl.[5] ..... A63B 55/00

[52] U.S. Cl. ..... 206/315.3; 206/315.6; 206/315.7

[58] Field of Search ..... 206/315.2–315.8; 248/96

[56] References Cited

U.S. PATENT DOCUMENTS

| | | | |
|---|---|---|---|
| 1,741,057 | 12/1929 | Howe | 206/315.8 |
| 1,826,216 | 10/1931 | Johnson | 206/315.6 |
| 2,629,609 | 2/1953 | Wilson | 206/315.5 X |
| 2,855,967 | 10/1958 | Wycherley | 206/315.8 |
| 4,378,039 | 3/1983 | Suk | 206/315.8 |
| 4,448,305 | 5/1984 | Sup | 206/315.8 |
| 4,506,854 | 3/1985 | Kim | 248/96 |
| 4,635,793 | 1/1987 | Kim | 206/315.6 |

FOREIGN PATENT DOCUMENTS

| | | | |
|---|---|---|---|
| 8333 | of 1911 | United Kingdom | 206/315.5 |
| 205431 | 10/1923 | United Kingdom | 206/315.6 |
| 0400474 | 10/1933 | United Kingdom . | |
| 2155341 | 9/1985 | United Kingdom . | |

*Primary Examiner*—Sue A. Weaver
*Attorney, Agent, or Firm*—Sandler, Greenblum & Bernstein

[57] ABSTRACT

Golf bag formed of an upper plate and a bottom connected to one another by a tubular wall made of a flexible material affixed at each of its ends to the upper plate and bottom. The upper plate is provided with openings for the passage of golf clubs. An internal tensioning shaft extends longitudinally between the bottom and the upper plate. The tensioning shaft is spring biased such that the upper end of the tensioning shaft is engaged in a seat provided in the lower surface of the upper plate. The seat is in lateral communication with an access ramp on which the upper end of the tensioning shaft slides before engaging in the seat into which it is pushed by the spring bias.

32 Claims, 4 Drawing Sheets

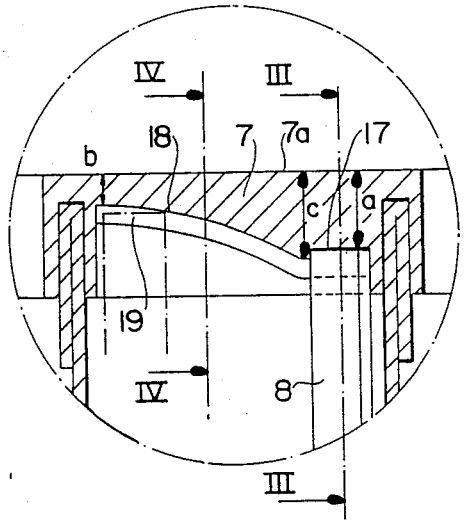
Fig_2
Fig_1
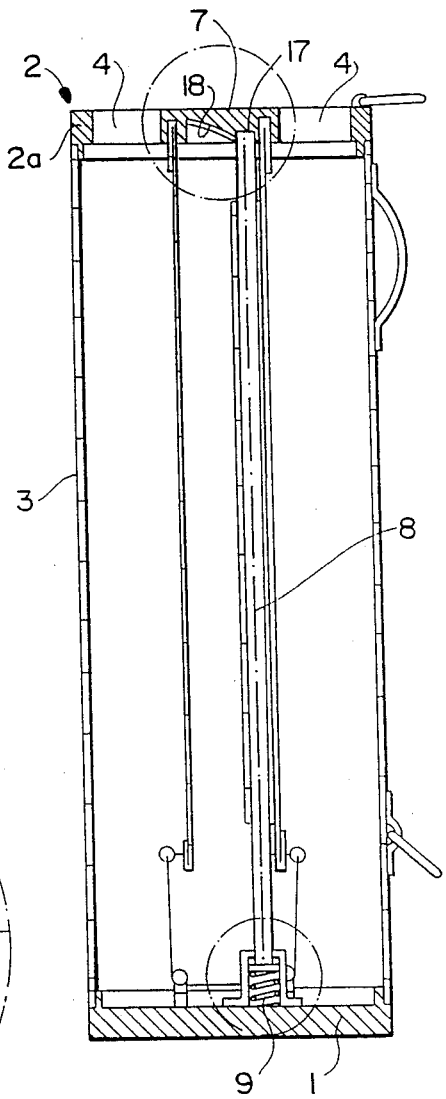
Fig_3
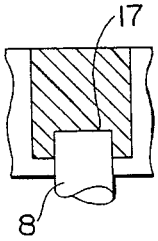
Fig_4
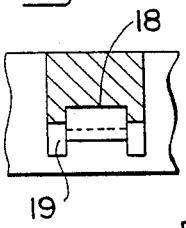
Fig_5
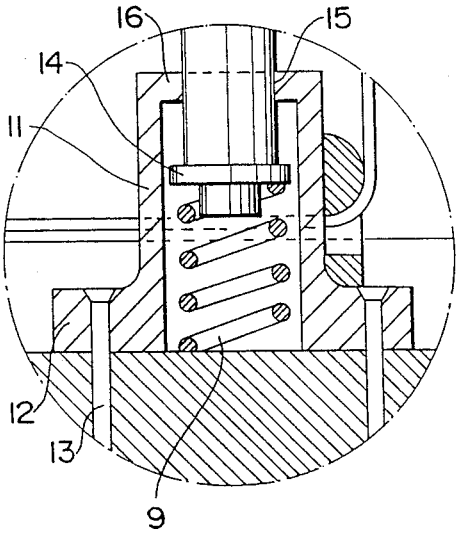

GOLF BAG

This application is a continuation of application Ser. No. 07/186,143, filed Apr. 26, 1988, abandoned.

BACKGROUND OF THE INVENTION

1. Field of the Invention

The present invention relates to a golf bag having an interior tensioning shaft.

2. Description of Background and Relevant Information

Known golf bags presently generally comprise a bottom end and an upper plate, preferably made of molded plastic material, to which are respectively attached the upper and lower ends of a tubular wall of flexible material, for example canvas, in a manner so as to constitute a tubular container, open at is upper portion, to receive various golf clubs. The upper plate of the bag is provided with different openings for receiving the clubs and it comprises a transverse member under which the upper end of an interior longitudinal tensioning shaft is supported, the lower end of which is connected to the bottom of the bag. Manufacturers of golf bags can thus deliver them flat to retailers, which makes it possible to reduce their volume during their transport and storage before sale. At the time of sale, the retailer assembles the bag for the purchaser and to this end he must position the interior tensioning shaft which causes a mutual spacing of the upper plate and the bottom of the bag thus ensuring satisfactory tensioning of the tubular wall of the bag.

The apparatus for tensioning golf bags which are known at this time are relatively complex and inconvenient to use. One of them utilizes a tensioning shaft which is supported under the transverse member of the upper plate but is threaded at its lower portion and screwed into a nut formed at the bottom of the bag. It is thus necessary to turn the tensioning shaft in its nut until obtaining the appropriate tensioning. This operation requires the use of a special tool and is relatively long and inconvenient. Furthermore, this apparatus for tensioning requires the use of a threaded shaft and of a nut and is thus relatively costly.

SUMMARY OF THE INVENTION

The invention is directed to a golf bag comprising an upper plate and a bottom connected to one another by a tubular wall made of a flexible material affixed at each of its ends to the upper plate and bottom. The upper plate is provided with openings for the passage of golf clubs, and the bag has a an internal tensioning shaft extending longitudinally between the bottom and the upper plate. The tensioning shaft is spring biased with the upper end of the tensioning shaft being engaged in a seat provided in the lower surface of the upper plate. The seat is in lateral communication with an access ramp on which the upper end of the tensioning shaft slides before engaging in the seat into which it is pushed by the spring bias.

The shaft is preferably biased by a spring positioned between the bottom and the bottom of the tensioning shaft. The seat is a hollow on the lower surface of the upper plate, and is positioned under a transverse member formed in the upper plate.

The access ramp is inclined from top to bottom in the direction of the hollow.

The spring is positioned within a container applied to the bottom or molded of one piece therewith. The container may be cylindrical, or alternatively may be in the form of a truncated cone from the exterior to the interior, the spring being engaged by deformation in the interior.

In yet another embodiment the extreme lower portion of the tensioning shaft is engaged and retained within the compartment by means of an annular collar under which the spring is supported and whose diameter is greater than that of a hole traversed by the tensioning shaft in the upper horizontal surface of the compartment.

The access ramp itself, may, in one embodiment, be constituted by a groove defined by two downwardly projecting lateral edges.

In the embodiment shown the distance between the bottom of the hollow and the upper surface of the upper plate is greater than the distance between the upper surface of the plate and the surface of the access ramp at the end of the groove which is spaced from the hollow. The upper surface of the upper plate at the location where the groove is connected to the hollow is spaced from the lower end of the hollow by a distance slightly greater than the distance defined between the bottom of the hollow and the upper surface of the upper plate. The hollow has a small depth just sufficient to retain the upper end of the tensioning shaft.

The spring may be force fitted on the lower end of the tensioning shaft and be freely engaged in a container formed on the internal surface of the bottom of the bag. The upper portion of the spring may be force fitted directly on the lower end of the tensioning shaft, with the lower end being adapted to have the spring force fitted thereon. Alternatively, the upper portion of the spring is force fitted on an intermediate tip which caps the lower end of the tensioning shaft by a peripheral cylindrical skirt, of the same internal diameter, extending upwardly and which furthermore comprises a tail, of smaller diameter, extending downwardly and on which the spring is fitted. The tail may a frustoconical shape which converges downwardly.

BRIEF DESCRIPTION OF DRAWINGS

The invention will now be described with reference to the annexed drawings, given by way of non-limiting example only, of several embodiments of the present invention, with reference to the annexed drawing in which:

FIG. 1 is a longitudinal and vertical cross-sectional view of a golf bag according to the invention;

FIG. 2 is a vertical cross-sectional view, on a magnified scale, of the central portion of the upper plate of the bag;

FIG. 3 is a vertical cross-sectional view along line III—III of FIG. 2;

FIG. 4 is a vertical cross-sectional view along line IV—IV of FIG. 2;

FIG. 5 is a vertical cross-sectional view, on a larger scale, of the central portion of the bottom of the bag;

DESCRIPTION OF PREFERRED EMBODIMENTS

Figure 5A:
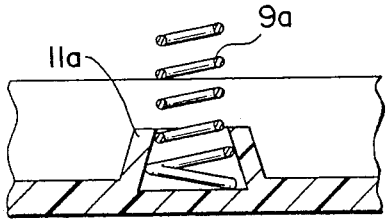
FIG. 5*a* illustrates an alternative compartment for the bottom of the tensioning shaft.

It is an aim of the present invention to overcome the disadvantages enumerated above by providing an apparatus for tensioning a golf bag which is of particularly simple design and very easy to use.

To satisfy the above objectives the golf bag of the invention comprises a bottom and an upper plate connected to one another by a tubular wall made of a flexible material which is fixed at its two ends to the bottom and to the upper plate. The upper plate is provided with openings for the passage of clubs before being seated within the bag, and an internal tensioning shaft extending longitudinally between the bottom and a transverse member which forms a part of the upper plate. The bag is characterized in that the lower end of the tensioning shaft is supported on the bottom by means of a compression spring and its upper end is engaged in a hollowed portion provided in the lower surface of the transverse member of the upper plate. The hollowed portion is associated with an access ramp which is inclined from top to bottom in the direction of the hollow and on which can slide the upper end of the shaft before being engaged in the hollow in which it is pushed by the compressed spring between the lower end of the shaft and the bottom of the bag.

According to another embodiment of the invention improvements are provided to the golf bag and more particularly to the mode of assembling the compression spring which assures the bias of the tensioning shaft so as to allow for easier assembly of the shaft and of the entire bag.

To this end the compression spring is force fitted on the lower end of the tensioning shaft and it is freely engaged in a receiving seat formed on the internal surface of the bottom of the bag.

The apparatus of the alternative embodiment provides a reception seat for the compression spring on the bottom which is less cumbersome in height such that a bottom of lesser height and lesser thickness results. This reduction of dimension causes an improvement in the appearance of the bag, a reduction in the weight thereof and a simplification of its manufacture.

One embodiment of the bag according to the invention is shown in FIG. 1 and comprises a bottom 1 and an upper plate 2, preferably formed of a molded plastic material, and a tubular wall 3, made out of a flexible material, such as canvas, attached at its two ends, respectively, to the bottom 1 and to the upper plate 2. Bottom 1 is totally closed while upper plate 2 has openings 4 to allow for the passage of the upper portions of clubs to be placed within the bag. There are, for example, four of these openings and they are provided between edge 2*a* of the upper plate and three transverse members in the form of an "H", i.e., two parallel transverse members 5 and 6 (FIG. 6) and a median transverse member 7 extending between them.

Figure 6:
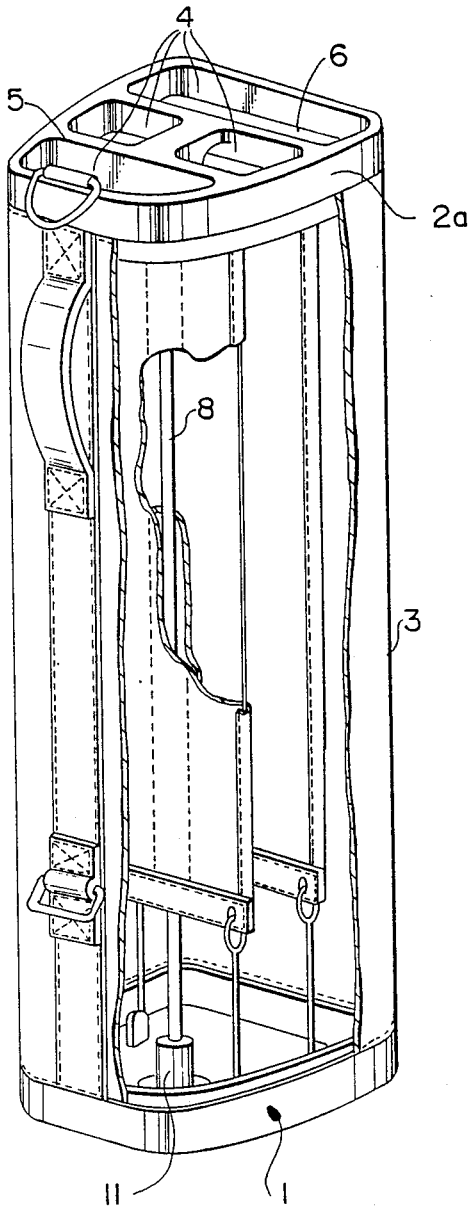
FIG. 6 is a perspective view, with partial break-away, of the golf bag.

When the golf bag is assembled, as is shown in FIGS. 1 and 6, the tensioning of its tubular wall is ensured by means of an interior vertical tensioning shaft 8 which extends between bottom 1 and upper plate 2. Tensioning shaft 8 has a length which is slightly less than the length of tubular wall 3 once the bag wall has been stretched.

According to the invention the tensioning shaft is supported against the upper surface of bottom 1 by means of a compression spring 9 positioned within compartment 11 which can be mounted on bottom 1 or be molded therein. Compartment 11 may be cylindrical, as shown in FIG. 5, or may be in the form of a truncated conical shape from the exterior to the interior 11*a* (FIG. 5*a*), spring 9*a* being engaged through deformation within. In the non-limiting embodiment shown in FIG. 5 compartment 11 is provided, at its lower end, with an external skirt 12 having rivets 13 extending therethrough to ensure the attachment of compartment 11 on bottom 1. The lower external portion of tensioning shaft 8 is engaged and retained within compartment 11 by any appropriate means. For example, it can comprise an annular collar 14, under which is supported spring 9 and whose diameter is greater than that of hole 15 which is traversed by shaft 8 in the upper horizontal surface 16 of compartment 11.

The upper end of shaft 8 is engaged and retained in a hollow 17 formed in the lower surface of median transverse member 7 of upper plate 2. This hollow 17 cooperates with an inclined access ramp 18 which is provided in the lower surface of transverse member 7. In fact, access ramp 18 is constituted by a groove defined by two downwardly extending lateral edges 19. Furthermore, the shape of groove 18 is selected such that it is inclined from top to bottom in the direction of hollow 17. Otherwise stated, distance "a" between the bottom of hollow 17 and the upper surface 7*a* of transverse member 7 is greater than the distance "b" between the left end of groove 18, i.e., the one which is spaced from hollow 17 and upper surface 7*a*. To the right end of groove 18 where it is connected to hollow 17, the distance "c" between this right end and upper surface 7*a* is slightly greater than the distance "a" and hollow 17 has a small depth just sufficient to retain the upper end of shaft 8.

By virtue of the above construction, the assembly of the bag according to the invention is performed very easily. It suffices in effect to engage the upper end of the tensioning shaft 8 in the groove or ramp 18 as is indicated in dashed lines in FIG. 2, in the portion thereof which is close at its left end, i.e., in the zone of reduced thickness "b" of transverse member 7. This can be done easily because canvas 3 is not as yet stretched. One then slides the upper end of tensioning shaft 8 towards the right along inclined ramp 18 which serves to progressively push transverse member 7 and consequently upper plate 2 upwardly, until the upper end of shaft 8, having gone beyond the right end of ramp 18 where thickness "c" is maximum, escapes ramp 18 and can be pushed into hollow 17, under the effect of lower compression spring 9. One thus obtains an elastic locking of the upper end of shaft 8 in hollow 17 and upper plate 2 and bottom 1 are spaced from one another under the effect of the force created by compression spring 9 which ensures the desired tensioning of canvas 3.

Figure 7:
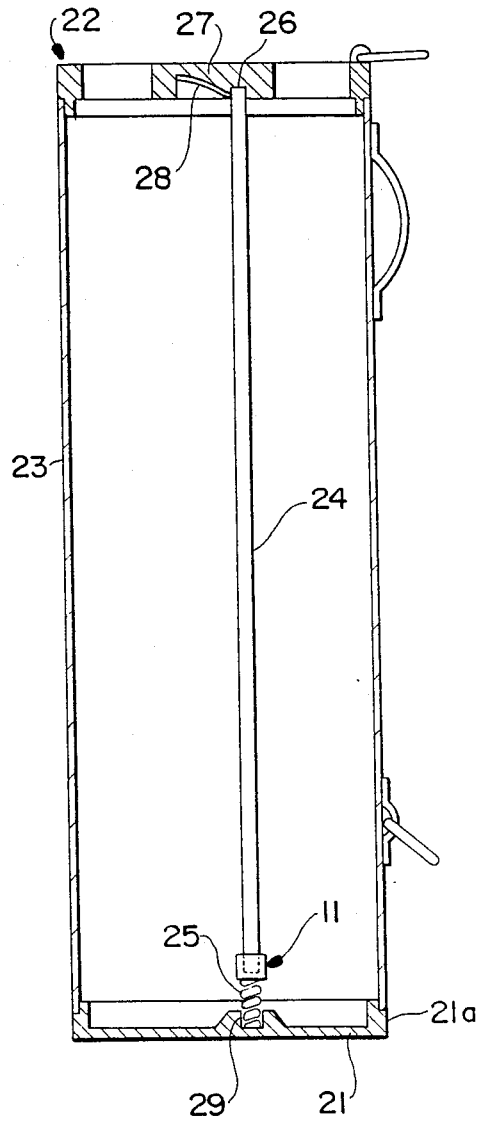
FIG. 7 is a longitudinal and vertical cross-sectional view of another embodiment of the golf bag according to the invention.

Referring to the embodiment of FIG. 7, the golf bag according to the alternative embodiment comprises a bottom 21 and an upper plate 22, preferably formed of a molded plastic material, and a tubular wall 23 made of a flexible material, such as canvas, affixed at its two ends respectively to bottom 21 and upper plate 22. When the golf bag is assembled, as is shown in FIG. 7, the tensioning of its tubular wall 23 is ensured by means of a vertical interior tensioning shaft 24 which extends between bottom 21 and upper plate 22. This tensioning shaft 24 is supported on the upper surface of bottom 21 by means of a compression spring 25 and its upper end is engaged and retained in a hollow 26 formed in the lower surface of a transverse member 27 of upper plate 22. Hollow 26 is in communication with an inclined access ramp 28 which is provided in the lower surface of transverse member 27.

Figure 8:
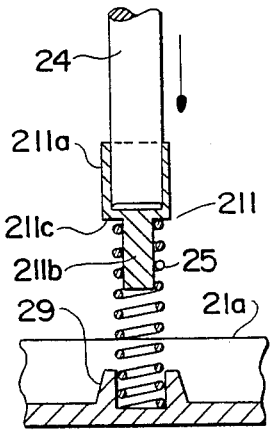
FIG. 8 is a partial vertical cross-sectional view of the bag of FIG. 7, on a magnified scale, of the lower portion of the bag, during the positioning of the tensioning shaft.
Figure 9:
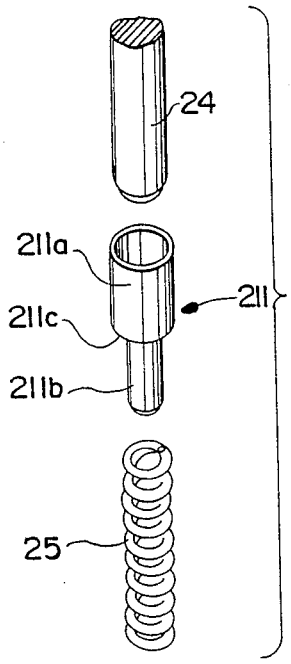
FIG. 9 is an exploded perspective view of the lower portion of the tensioning shaft of FIG. 7.

As seen in FIG. 8, compression spring 25 is force fitted on the lower end tensioning shaft 24 and is freely engaged in a receiving seat 29 which is provided to project from the internal surface of bottom 21. This seat 29 can preferably be molded of one piece with bottom 21 as is shown in the drawing or it can be affixed to the bottom. Seat 29 has the shape of a column in which is engaged the lower portion of spring 25. The upper portion of spring 25 can be force fitted directly on the lower end of shaft 24, configured for this purpose, or which is preferably fitted onto an intermediate tip 211 which caps the lower extreme end of shaft 24 by a cylindrical skirt 211*a* of the same diameter, extending upwardly. Tip 211 furthermore comprises a tail 211*b* of smaller diameter, extending downwardly and on which is force fitted compression spring 25. Tail 211*b* preferably has a truncated frustoconical shape (FIG. 9), which converges downwardly, to ensure a force fitting of spring 25 on tail 211*b*. The spring is further retained on top by an external annular shoulder 211*c* formed at the junction between the upper skirt 211*a* and the lower tail 211*b*.

As may be seen in FIG. 8 receiving seat 29 for spring 25 has a low height, less than the height of peripheral skirt 21*a* of bottom 21. Bottom 21 can thus have in its entirety a very reduced height, which improves its aesthetic qualities and leads to a lightening of the bag.

Although the invention has been described with reference to particular means, materials, and embodiments, it is to be understood that the invention is not limited to the particulars disclosed and extends to all equivalents within the scope of the claims.

We claim:

1. A golf bag comprising an upper plate and a bottom connected to one another by a tubular wall make of a flexible material affixed at each of its ends to said upper plate and said bottom, said upper plate being provided with openings for the passage of golf clubs, and internal tensioning shaft extending longitudinally between said bottom and said upper plate, and means for spring biasing said tensioning shaft between said bottom and said upper plate, and wherein the upper end of said tensioning shaft is engaged in a seat provided in the lower surface of said upper plate, said seat being in communication with a laterally extending access ramp on which said upper end of said tensioning shaft slides before engaging in said seat into which it is pushed by said means for spring biasing said tensioning shaft.

2. The golf bag as defined by claim wherein said means for spring biasing said tensioning shaft comprises a spring positioned between said bottom and the bottom of said tensioning shaft.

3. The golf bag as defined by claim 2 wherein said seat is a hollow on the lower surface of said upper plate.

4. The golf bag as defined by claim 3 wherein said hollow is positioned under a transverse member formed in said upper plate.

5. The golf bag as defined by claim 4 wherein the access ramp is inclined from top to bottom in the direction of the hollow.

6. The golf bag as defined by claim 2 wherein said spring is positioned within a compartment applied to said bottom.

7. The golf bag as defined by claim 2 wherein said spring is positioned in a container compartment molded within said bottom.

8. The golf bag as defined by claim 6 wherein said compartment is cylindrical.

9. The golf bag as defined by claim 7 wherein said compartment is cylindrical.

10. The golf bag as defined by claim 6 wherein said compartment comprises means for frictionally engaging said spring, wherein said compartment is shaped as a truncated cone and wherein said spring is frictionally engaged in said compartment by said means for frictionally engaging said spring.

11. The golf bag as defined by claim 7 wherein said compartment comprises means for frictionally engaging said spring, wherein said compartment is shaped as a truncated cone and wherein said spring is frictionally engaged in said compartment by said means for frictionally engaging said spring.

12. The golf bag as defined by claim 6 wherein said compartment has an upper surface, wherein the extreme lower portion of said tensioning shaft is engaged and retained within said compartment by means of an annular collar affixed to said tensioning shaft under which said spring is supported and whose diameter is greater than that of a hole traversed by said tensioning shaft in said upper surface of said compartment.

13. The golf bag as defined by claim 7 wherein said compartment has an upper surface, wherein the extreme lower portion of said tensioning shaft engaged and retained within said compartment by means of an annular collar affixed to said tensioning shaft under which said spring is supported and whose diameter is greater than that of a hole traversed by said tensioning shaft in said upper surface of said compartment.

14. The golf bag as defined in claim 1 wherein said access ramp is constituted by a groove defined by two downwardly projecting lateral edges.

15. The golf bag as defined by claim 1 wherein the distance between the bottom of the hollow and the upper surface of the upper plate is greater than the distance between the upper surface of the plate and the surface of the access ramp at the end of the groove which is spaced from the hollow, and wherein the upper surface of the upper plate at the location where the groove is connected to the hollow is spaced from the lower end of said hollow by a distance slightly greater than the distance defined between the bottom of the hollow and the upper surface of the upper plate, and the hollow has a small depth just sufficient to retain the upper end of said tensioning shaft.

16. The golf bag as defined by claim 6 wherein said tensioning shaft has a lower end which comprises means for frictionally engaging said spring, wherein said spring is frictionally engaged by said means for frictionally engaging said spring on said lower end of said tensioning shaft and wherein said lower end of said tensioning shaft is freely received within said compartment formed on the internal surface of the bottom of the bag.

17. The golf bag as defined by claim 16 wherein the upper portion of the spring is force fitted directly on the lower end of said tensioning shaft, said lower end being adapted to have said spring force fitted thereon.

18. The golf bag as defined by claim 16 wherein the upper portion of said spring is force fitted on an intermediate tip which caps the lower end of said tensioning shaft by a peripheral cylindrical skirt, of the same diameter, extending upwardly and which furthermore comprises a tail, of smaller diameter, extending downwardly and on which said spring is fitted.

19. The golf bag is defined by claim 18 wherein said tail has a frustoconical shape which converges downwardly.

20. The golf bag as defined by claim 2 wherein said access ramp extends in a substantially radial direction toward said seat.

21. The golf bag as defined by claim 16 wherein said spring is a coil spring and wherein said lower end of said tensioning shaft is inserted within said coil spring to effect a frictional engagement therebetween.

22. The golf bag as defined by claim 7 wherein said tensioning shaft has a lower end which comprises means for frictionally engaging said spring, wherein said spring is frictionally engaged by said means for frictionally engaging said spring on said lower end of said tensioning shaft and wherein said lower end of said tensioning shaft is freely received within said compartment formed on the internal surface of the bottom of the bag.

23. A golf bag comprising:

(a) an upper member, including openings for receiving golf clubs therethrough;

(b) a lower member spaced from said upper member;

(c) a tubular wall extending between said upper member and said lower member;

(d) a tensioning shaft extending between said upper member and said lower member, said tensioning shaft having an upper end and a lower end;

(e) means for maintaining said tensioning shaft under tension between said member and said lower member, comprising a seat located in at least one of said upper member and said lower member; and (f) means for guiding at least one of said upper end and said lower end of said tensioning shaft into said seat, wherein said means for guiding are positioned laterally of said seat.

24. The golf bag of claim 23 wherein said means for guiding comprises an access ramp extending transversely of said tensioning shaft in communication with said seat.

25. The golf bag of claim 24 wherein said access ramp comprises a groove and a pair of lateral edges for facilitating said guiding of said tensioning shaft into said seat.

26. The golf bag of claim 24 wherein said access ramp comprises a guiding surface extending toward said seat such that the distance between said guiding surface and an opposite end of said golf bag decreases along said guiding surface in a direction toward said seat.

27. The golf bag of claim 26 wherein said seat has an end surface and wherein the distance between said opposite end of said bag and said end surface of said seat is greater than the distance between said opposite end of said golf bag and said guiding surface at the junction of said guiding surface and said seat.

28. The golf bag of claim 23 wherein said seat is located in said upper member.

29. The golf bag of claim 28 wherein said tensioning shaft has a predetermined cross-sectional shape and wherein said seat comprises a recess having a cross-sectional shape complementary to that of said predetermined cross-sectional shape of said tensioning shaft.

30. The golf bag of claim 23 wherein said means for guiding are attached to said seat.

31. The golf bag of claim 23 wherein said means for guiding communicate with said seat.

32. The golf bag of claim 23 wherein said means for guiding comprises a guiding surface extending laterally with respect to said seat.

* * * * *

UNITED STATES PATENT AND TRADEMARK OFFICE

CERTIFICATE OF CORRECTION

PATENT NO. : 4,967,904

DATED : November 6, 1990

INVENTOR(S) : J. QUELLAIS et al.

It is certified that error appears in the above-identified patent and that said Letters Patent is hereby corrected as shown below:

Column 5, line 46 (claim 1, line 2), change "make" to ---made---.

Column 5, line 49 (claim 1, line 5), change "and" to ---an---.

Column 5, line 60 (claim 2, line 1), insert ---1--- after "claim".

Column 6, line 37 (claim 13, line 3), insert ---is--- after "shaft".

Column 6, line 46 (claim 15, line 1), change "1" to ---14---.

Column 7, line 39 (claim 23, line 11), insert ---upper--- after "said". (1st occurrence).

Column 8, line 21 (claim 27, line 3), insert ---golf--- after "said" (first occurrence).

Signed and Sealed this

Twenty-third Day of February, 1993

*Attest:*

STEPHEN G. KUNIN

*Attesting Officer*

*Acting Commissioner of Patents and Trademarks*